US009312614B2

(12) United States Patent
Harvey

(10) Patent No.: US 9,312,614 B2
(45) Date of Patent: Apr. 12, 2016

(54) ELECTRICAL CONNECTOR FOR AN ANODE

(71) Applicant: Fugro Subsea Services Limited, Aberdeen (GB)

(72) Inventor: William Ian Harvey, North Walsham (GB)

(73) Assignee: Fugro Subsea Services Limited, Aberdeen (GB)

( * ) Notice: Subject to any disclaimer, the term of this patent is extended or adjusted under 35 U.S.C. 154(b) by 0 days.

(21) Appl. No.: 14/407,233

(22) PCT Filed: Jun. 11, 2013

(86) PCT No.: PCT/GB2013/051528
§ 371 (c)(1),
(2) Date: Dec. 11, 2014

(87) PCT Pub. No.: WO2013/186548
PCT Pub. Date: Dec. 19, 2013

(65) Prior Publication Data

US 2015/0180145 A1 Jun. 25, 2015

(30) Foreign Application Priority Data

Jun. 12, 2012 (GB) ..... 1210361.0

(51) Int. Cl.
*H01R 11/30* (2006.01)
*C23F 13/20* (2006.01)
*C23F 13/00* (2006.01)

(52) U.S. Cl.
CPC ..... *H01R 11/30* (2013.01); *C23F 13/005* (2013.01); *C23F 13/20* (2013.01); *C23F 2213/31* (2013.01); *Y10T 29/49117* (2015.01)

(58) Field of Classification Search
CPC ..... H01R 13/6205
USPC ..... 439/39, 246
See application file for complete search history.

(56) References Cited

U.S. PATENT DOCUMENTS 3,513,082 A 5/1970 Beer et al.
3,786,391 A * 1/1974 Mathauser ..... H01R 13/6205 335/205

(Continued)

FOREIGN PATENT DOCUMENTS

CN 200988862 Y 12/2007
CN 101812691 A 8/2010

(Continued)

OTHER PUBLICATIONS

Cujuhovschi, Oana, "International Search Report," prepared for PCT/GB2013/051528, as mailed Dec. 4, 2013, four pages.

*Primary Examiner* — Phuong Dinh
(74) *Attorney, Agent, or Firm* — Winstead PC

(57) ABSTRACT

An electrical connector for an anode has a terminal for an electric cable, at least two magnet devices for attracting the connector onto a metal structure, a plate electrically connecting the magnet devices to one another and to the terminal, and a deformable member connecting the magnet devices. When the connector connects an anode to a surface, the magnet forces draw the magnet devices against the surface in order to make up the connection. The deformable member allows relative movement of the magnet devices, permitting them to align themselves in an optimum configuration to maximize the surface area of the magnet devices that are in contact with the metal structure, providing a large electrical conduit between the connector and the cable connected to the terminal, and allowing for more reliable electrical connection between the anode and the structure.

25 Claims, 5 Drawing Sheets

(56) References Cited

U.S. PATENT DOCUMENTS

| | | | | |
|---|---|---|---|---|
| 3,805,557 | A * | 4/1974 | Seegers | D04B 39/00 66/147 |
| 3,810,258 | A * | 5/1974 | Mathauser | H01R 13/6205 439/246 |
| 5,203,709 | A | 4/1993 | Huang | |
| 7,341,458 | B1 * | 3/2008 | Koh | H01R 13/2421 439/39 |
| 7,344,379 | B2 * | 3/2008 | Marmaropoulos | H01R 13/6205 439/37 |
| 8,602,795 | B2 * | 12/2013 | Hsu | H01R 13/6205 439/39 |
| 2003/0196912 | A1 | 10/2003 | Morgan | |
| 2007/0072443 | A1 | 3/2007 | Rohrbach et al. | |
| 2008/0311765 | A1 | 12/2008 | Chatterjee et al. | |

FOREIGN PATENT DOCUMENTS

| | | | |
|---|---|---|---|
| DE | 2923138 | A1 | 12/1980 |
| JP | 2008274358 | A | 11/2008 |

* cited by examiner

ELECTRICAL CONNECTOR FOR AN ANODE

BACKGROUND

1. Technical Field

This invention relates to an apparatus and method for making electrical connections from an anode to a subsea structure for the purpose of cathodic protection of the subsea structure by sacrificial corrosion of the anode.

2. Description of Related Art

Anodes are frequently connected to metal structures used in and on the sea, to protect the integrity of the metal structure by cathodic protection. Anodes are formed from metals which sacrificially corrode in preference to the metal structure, which functions as the cathode in the electrochemical circuit formed between the anode and the metal structure. The anode is typically replaced periodically as it corrodes.

Cathodic protection typically requires an electrical connection between the anode and the structure being protected. Connection of anodes to submerged metal structures such as legs for platforms is typically accomplished by bolting or welding the anode connections in place in order to penetrate any protective coatings on the metal structure, such as paint and the like or marine growth such as algae, etc. in order to ensure an effective electrical connection between the anode and the metal structure being protected.

SUMMARY

According to the present invention there is an electrical connector for connecting an anode to a subsea metal structure to be protected by the anode by cathodic protection, the connector comprising:

- a terminal for an electric cable to be connected to the anode;
- at least two magnet devices for attracting the connector onto a surface of the metal structure by magnetic forces acting between the magnet devices and the surface of the metal structure;
- an electrical contact member (e.g. a plate) electrically connecting the magnet devices to one another and to the terminal, in order to electrically connect the terminal to the surface of the metal structure through each of the magnet devices;
- and wherein the magnet devices are connected by a deformable member that deforms to permit relative movement of the magnet devices relative to one another.

When the connector is applied to a surface, the magnet devices typically create an attractive force between the connector and the surface, which draws the magnet devices towards the surface in order to make up the connection. The deformable member allows relative movement of the magnet devices, permitting them to align themselves under the force of the magnetic attraction generated by each magnet device, in an optimum configuration, which need not necessarily be planar, in order to maximise the surface area of the magnet devices that are in contact with the metal structure, providing a large electrical conduit between the connector and the cable connected to the terminal, and allowing for more reliable electrical connection between the anode and the structure. Thus the magnet devices self align in an optimal configuration of the array of magnet devices. Also each individual magnet device aligns itself with the surface in an orientation that provides the maximum contact area between that magnet device and the surface in order to maximise electrical conductivity for that particular magnet device, without damaging the electrical connectivity between the different magnet devices as the deformable member flexes to accommodate the movement.

Typically the magnet devices comprise at least one magnet optionally enclosed in a case.

Typically the magnet is a relatively strong magnet such as a rare earth magnet. Typical examples comprise samarium-cobalt and neodymium. Other types of magnet known to the skilled person can be adopted within the scope of the invention.

Optionally the magnet is electrically conductive, but in certain examples of the invention, the magnet can be non-conductive or conductive, and can be enclosed within a case formed from an electrically-conductive material which provides a reliable electrical connection between the metal structure being protected and the terminal of the connector. Typically the casing is formed from a corrosion resistant metal, such as stainless steel, and typically the casing entirely surrounds the magnet preventing seawater ingress through the case, and therefore resisting or substantially preventing corrosion of the magnet.

Typically the magnet devices have flat surfaces adapted to connect to the metal structure being protected. Optionally the surfaces of the magnet devices forming a connection with the structure do not need to be flat, and can be formed in other shapes that are complimentary to the surfaces of the metal structure to be protected. Optionally the surfaces forming a connection with the structure can be formed by the case.

Typically the connector has a manipulation plate which is typically connected to each of the magnet devices and is typically spaced away from the magnet devices, optionally in a parallel plane to the surface forming a connection with the structure. Typically the manipulation plate is generally planar, and at least part of it extends generally parallel to the electrical contact plate.

The electrical contact member can be a plate or some other shape of member. The electrical contact member is typically formed entirely from an electrically conductive material and is typically welded or otherwise securely connected to the cable terminal, and the magnet devices, typically to the casing of the magnet devices, so as to enhance electrical conductivity between the cable, terminal, electrical contact plate and the cases of the magnet devices in contact with the metal structure to be protected. Optionally, the electrical contact member can be formed from copper or a similar conductive metal.

Optionally, the deformable member can comprise a portion of the electrical contact member, and in one example of the invention, an electrical contact plate is provided in the form of a head portion attaching to each magnet device, and a central body portion connected to each of the magnet devices (i.e. to the head portions of the contact plate) by means of a neck portion. Typically the neck portion is relatively narrower than the head portion of the electrical contact plate, and is relatively weaker. Typically the neck portion is adapted to deform and provides the deformable member of the invention.

The deformability of the neck portion of the electrical contact plate can typically arise because of the structure of the deformable neck region, which in typical examples can be formed of thin or narrow strips of material adapted to electrically connect the magnets, but which also present substantially less physical resistance to deformation than other parts of the electrical contact plate, and so is adapted to bend to accommodate relative movements of the magnet devices in response to the attraction of the magnet devices to an uneven or non-planar surface on the subsea metal structure to be protected. Optionally the deformability can arise from an inherent plasticity (ability to deform permanently under load)

of the material used for the neck region, which can for example be formed of ductile or malleable material capable of deforming into a different shape under relatively low compressive or tensile forces, and typically being capable of permanently maintaining the deformed shape after removal of the load. Typically the deformable member can have increased capacity for bending. In many examples, the deformability can arise from both the structure and the malleable material characteristics of the member (e.g. the neck portion).

For example, in one example of the invention the electrical contact plate is typically formed in a single plane, with parallel and co-planar heads for each of the magnet devices, and conjoining neck portions, all of which are typically provided in the same plane, and are typically parallel to the contact faces of the magnet devices that are adapted to contact the surface of the subsea metal structure to be protected. In the case of a planar surface, typically relatively little deformation of the neck portions of the electrical contact plate takes place, but for example in the case of a subsea metal structure such as a spherical tank that has an arcuate outer surface for connection to the magnet devices, the generally planar contact faces of the magnet devices will typically be forced to attach to the outer arcuate surface of the tank in different angular orientations, causing deformation of the neck portions of the electrical contact plate to accommodate the relative movements of the magnet devices to one another, while still maintaining electrical contact between the magnet devices. The neck portions, being relatively thinner and narrower strips than the head portions of the electrical contact plate, preferentially deform between the magnet devices in order to accommodate the different angular orientations of the magnet devices, while still maintaining the electrical connection between the two magnet devices. Optionally the same deformable member can be formed of the same material as other regions of the connector, but can have a structure adapted to bend preferentially in the region of the deformable member. For example, the neck portions can optionally incorporate hinges or weakened portions adapted to bend in particular regions. Optionally the deformable member can comprise a weaker material in the region of the deformable member than other regions of the connector.

Typically the manipulation plate is connected to the magnet devices by a fixing such as a respective bolt connecting a head portion of the manipulation plate to a respective magnet device. Typically the manipulation plate is substantially resistant to deformation, or at least is more resistant to deformation than the deformable member i.e. the electrical contact plate. Typically the manipulation plate is formed in a generally similar structure to the electrical contact plate, with a head portion for each respective magnet device, and a neck portion interconnecting the head portions with a central body portion.

Optionally, the electrical contact plate and the manipulation plate have a respective head for each magnet device. In simple examples, the manipulation plate and electrical contact plate can comprise first and second heads interconnected by a single neck portion, but in examples of the invention with more than two magnet devices, typically the manipulation plate has a central body, and a respective head and neck portion connected to the central body for each magnet device. Optionally, the electrical contact plate can have a similar structure. Typically the connection between the magnet device and the manipulation plate permits limited relative movement to permit changes in orientation of the magnet devices relative to one another, for example in the process of connection to a non-planar surface. However, typically the extent of movement that is permitted by the manipulation plate is limited to a particular range, and typically substantial movements of one of the magnet devices to displace it out of the same general plane as the other magnet devices is typically limited by the manipulation plate to within the deformable characteristics of the deformable member, so that the relative movement of the magnet devices does not disrupt the electrical connection between the magnet devices.

The connection between the manipulation plate and the magnet devices is typically by means of fixings with shafts such as bolts, which typically extend through holes formed in the heads of the manipulation plate, and terminate in sockets, which are typically screw threaded on internal faces, in the magnet devices, and typically in the cases thereof. Therefore, the bolt is typically secured rigidly on the magnet device, but is typically simply restrained in the hole of the head of the manipulation plate so that it can move in a limited range relative to the manipulation plate.

Typically the bolt or other fixing is retained on the manipulation plate by a head which is substantially larger than the hole through the plate, but in certain examples, the shaft passing through the hole is typically smaller than the hole through the head of the manipulation plate, thereby allowing lateral movement of the shaft within the hole as the orientation of the magnet device connected to the shaft changes in response to the flexing of the deformable member as the connector settles on a non-planar surface.

Typically, the head of the bolt or other fixing is spaced along its axis from the upper surface of the manipulation plate, providing an axial clearance between the manipulation plate and the head of the bolt, thereby allowing generally small axial displacements of the magnet device connected to the bolt away from the plane of the other magnet devices until the head on the bolt engages with the upper surface of the manipulation plate, at which point further axial movement of the magnet device is limited by the substantially non-deformable manipulation plate.

The provision of the manipulation plate and its interconnection with the magnet devices typically allows high forces to be transferred direct to the magnet devices in order to place them in position during installation, and to remove them for maintenance or replacement, while minimising the transfer of forces to or through the relatively weaker deformable member, preventing damage to the deformable member during removal and replacement operations.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one example can typically be combined alone or together with other features in different examples of the invention.

BRIEF DESCRIPTION OF THE DRAWINGS

Various examples and aspects of the invention will now be described in detail with reference to the accompanying figures. Still other aspects, features, and advantages of the present invention are readily apparent from the entire description thereof, including the figures, which illustrates a number of exemplary constructions and aspects and implementations. The invention is also capable of other and different examples and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described and are not to be interpreted as limiting the invention to the literal interpretation of the term, but instead should be as understood by the skilled addressee.

Figure 1:
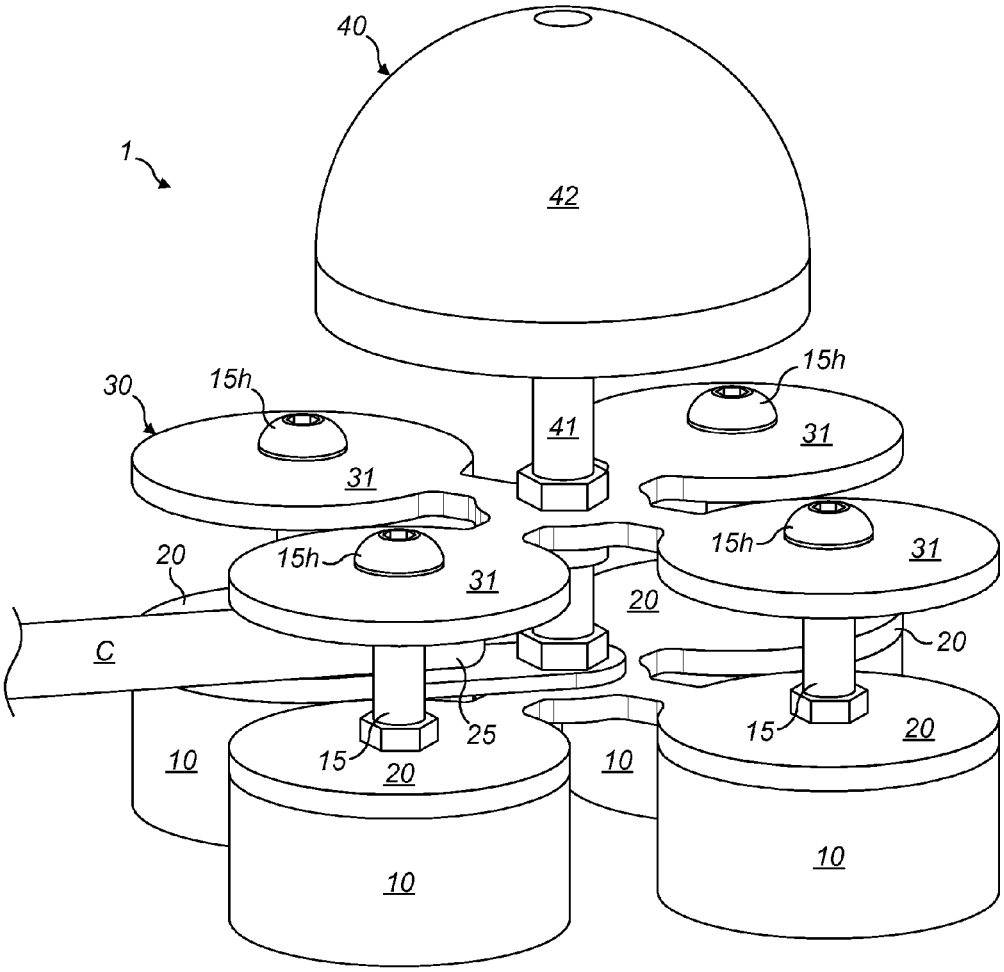
Figure 2:
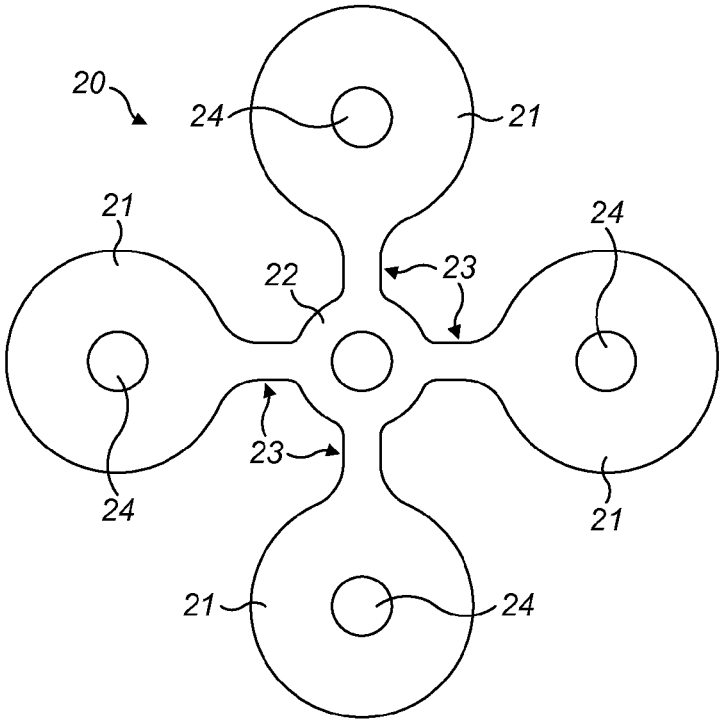
Figure 3:
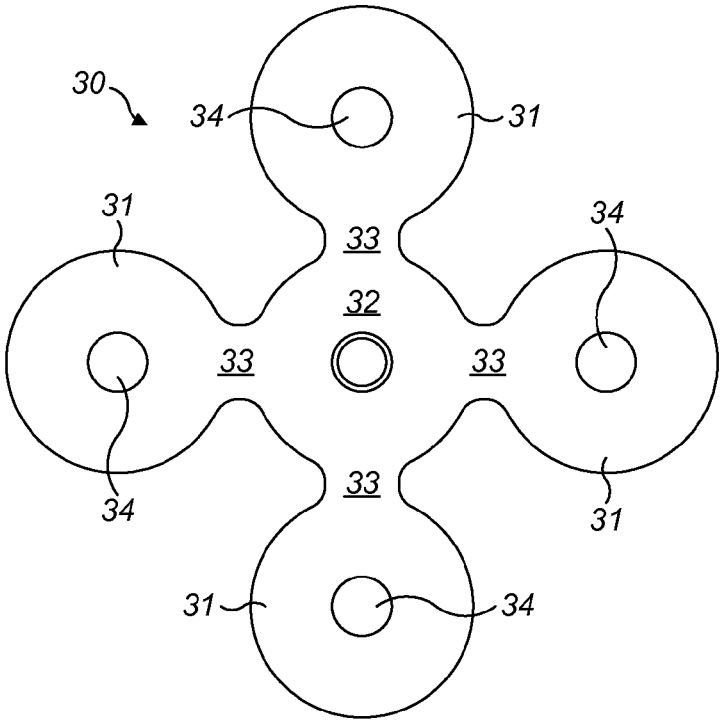
Figure 4:
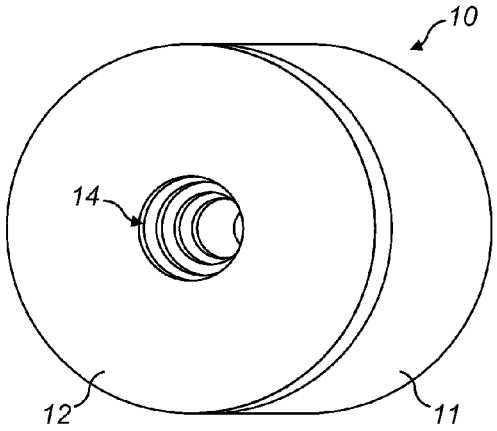
Figure 5:
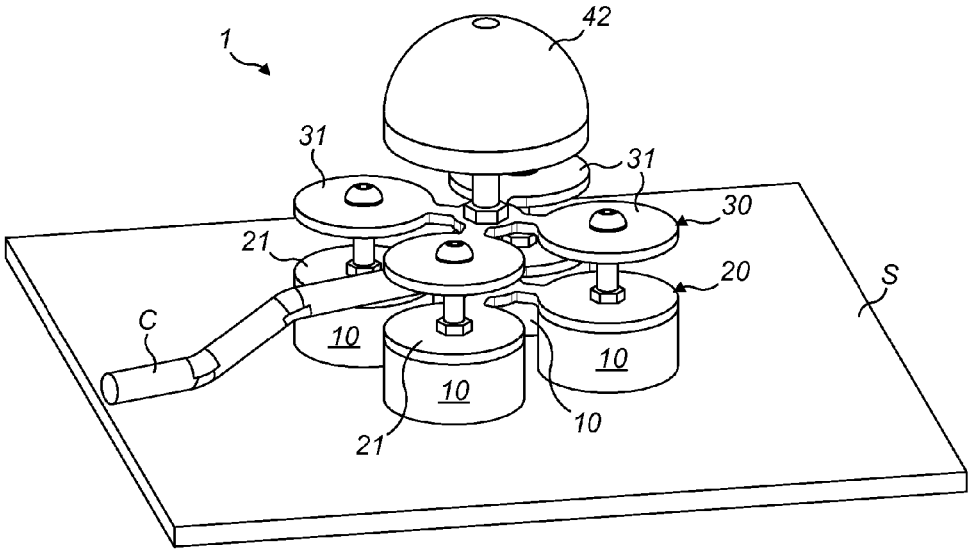
Figure 6:
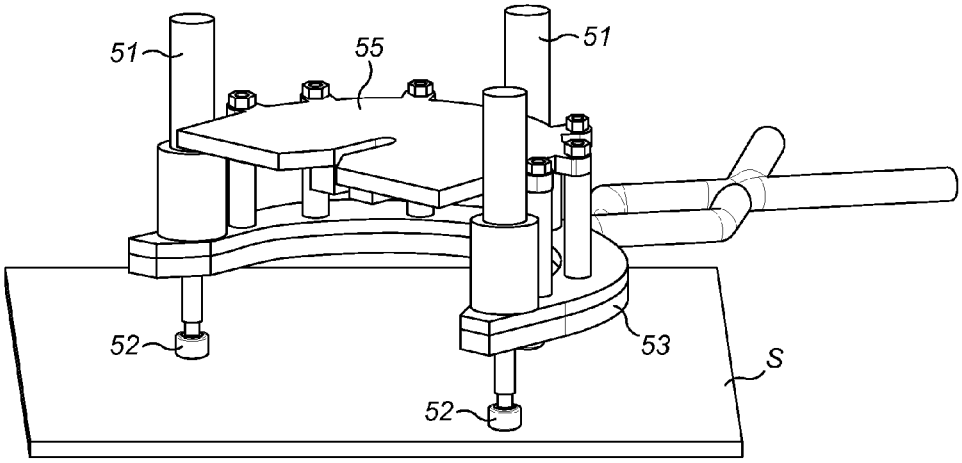
Figure 7:
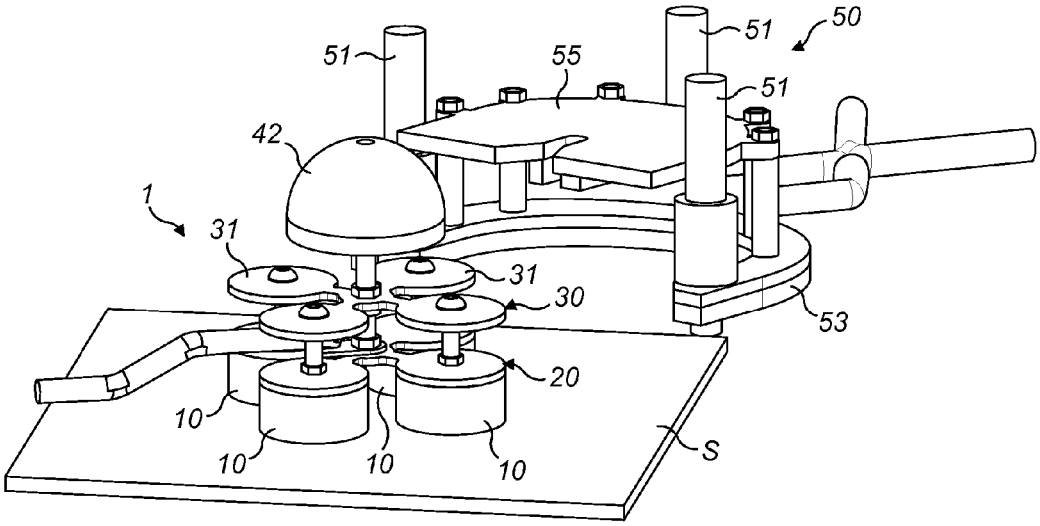
Figure 8:
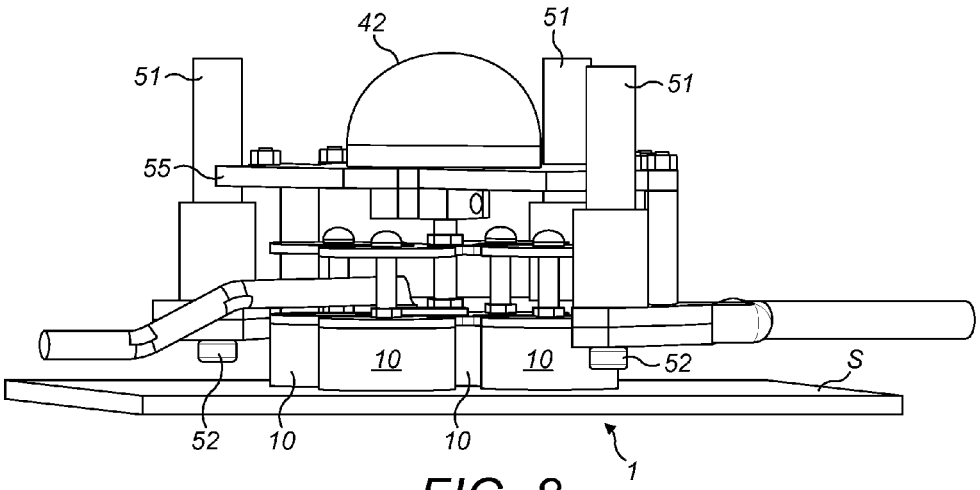
Figure 9:
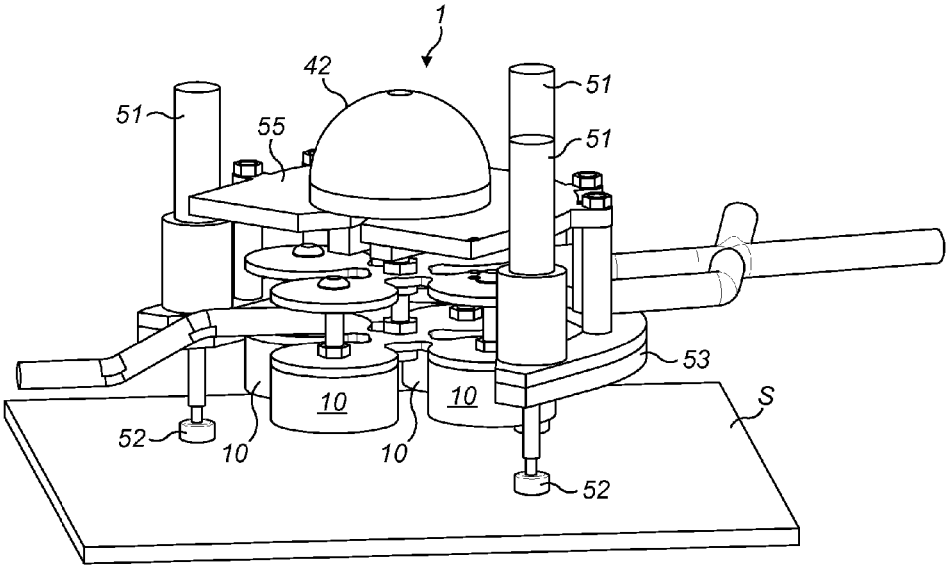

In the accompanying drawings:

FIG. 1 shows a perspective view of a connector according to one example of the invention;

FIG. 2 shows a plan view of a deformable member used in the FIG. 1 device;

FIG. 3 is a plan view of a manipulation plate used in the FIG. 1 device;

FIG. 4 is a perspective view from beneath a magnet device according to the FIG. 1 device;

FIG. 5 is a perspective view of the FIG. 1 device connected to the surface of a subsea metal structure;

FIG. 6 is a perspective view of a removal device used with the FIG. 1 device;

FIG. 7 is a perspective view of the removal device of FIG. 6 approaching the device of FIG. 1;

FIG. 8 is a perspective view of the removal device engaging the device of FIG. 1 on the surface; and FIG. 9 is a perspective view of the device of FIG. 1 being removed from the surface by the removal tool of FIG. 6.

DETAILED DESCRIPTION OF ILLUSTRATIVE EMBODIMENTS

Referring now to the drawings, an electrical connector 1 has four magnet devices 10 arranged substantially equidistantly from one another in a general square pattern. The magnet devices 10, shown in more detail in FIG. 4, comprise generally circular discs having flat upper and lower faces, and having an inner core of magnetic material, typically a rare earth magnetic material such as neodymium, and substantially encased by an external casing 11. Different examples can have different numbers of magnet devices 10. Typically the external casing 11 in this example is formed from stainless steel, although other conductive metals particularly those that are resistant to corrosion can be used. Typically each magnet device 10 has a central aperture 14 in the disc, which is internally threaded in at least a part of its bore to receive and retain a fixing such as a shaft of a bolt which will be described later. Optionally, the bore of the aperture 14 is only partially threaded and has an unthreaded end typically having a different diameter than the threaded end, to permit different sizes of bolts to be used to either engage the threads of the magnet device, or to pass through the bore and to permit the use of a fixing such as a nut set on the opposite face of the magnet device 10 and engaged on a shaft of a bolt.

Typically the magnet device 10 is entirely encased by the casing 11, which typically forms a barrier to prevent seawater ingress into the core of the magnet device 10.

The lower surface 12 of the magnet device 10 typically has a flat face adapted to contact a surface(s) of a subsea metal structure. The face can be some other shape in other examples, to be complimentary to the surface of the metal structure to be protected. The lower surface 12 typically comprises a part of the casing 11, or is at least electrically connected to the casing 11, so as to provide a robust electrical connection between the large surface area of the lower surface 12 and the casing 11.

The upper face of the magnet device 10 is typically connected e.g. by welding or clamping to an electrical contact member in the form (in this example) of an electrical contact plate 20, which is electrically connected to the casing 11 of the magnet device 10. The electrical contact plate 20, shown in more detail in FIG. 2, typically comprises a number of heads 21 arranged in a similar pattern to the magnet devices 10, and being connected to a central body portion 22 by means of neck portions 23. The head portions 21 have central apertures 24 which are aligned with threaded apertures 14 in the magnet devices 10. The electrical contact plate 20 is typically formed from a thin flat plate of electrically conductive material such as copper. The heads 21 of the electrical contact plate 20 typically fit over the upper surfaces of the casing 11 on each of the magnet devices 10, and provide a robust electrical connection between the electrical contact plate 20 and the casing 11 of each of the magnet devices 10. Optionally, the electrical contact plate 20 can be held onto the upper surface of the magnet devices 10 by a nut placed on the shaft of one of the bolts extending through the apertures 14 of the magnet devices 10, but typically the electrical contact plate can be welded or otherwise fixed over its entire surface the respective magnet devices 10.

The electrical contact plate 20 typically has a terminal, which can be provided on the body portion 22, or in some other portion. The terminal 25 typically allows the connection of cable C to the terminal which allows electrical connection between the cable C and the connector 1.

The central body portion 22 of the electrical contact plate 20 typically has a central aperture to permit connection of a central shaft connecting to a manipulation plate 30.

The manipulation plate 30 is shown in detail in FIG. 3. The manipulation plate 30 typically has the same number of heads 31 as the number of magnet devices (4 in this example), each head 31 having a central aperture 34, and each head 31 being connected to a central body portion 32 by means of a neck portion 33. The central body portion 32 has a central aperture aligned with the central aperture in the body portion 22 of the electrical contact plate 20. Likewise, the apertures 34 in the heads 31 of the manipulation plate 30 line up with the apertures 24 in the heads 21 of the electrical contact plate 20, and with the apertures 14 in the magnet devices 10. Bolts 15 having heads 15*h* and threaded shafts pass through the apertures 34, 24 and 14, to securely connect the threaded lower ends of the shafts directly to the magnet devices 10, so that the shafts of the bolts 15 are securely connected to the magnet devices 10 and move with them.

Typically the apertures 34 in the manipulation plate 30 have a larger internal diameter than the outer diameter of the shafts of the bolts 15, so that there is annular clearance between the shafts of the bolts 15 and the inner surface of the apertures 34, allowing some lateral movement of the shafts of the bolts 15 within the apertures 34 of the manipulation plate 30. The lateral movement of the shaft of the bolt 15 within the aperture 34 permits a small degree of independent movement of the magnet devices 10 relative to the plate 30 and relative to one another, but the range of lateral movement is limited by the annular clearance between the shaft of the bolt 15 and the aperture 34, and when the shaft engages the side of the aperture 34, further relative movement of the particular magnet device relative to the plate 30 is restricted.

Typically the head 15*h* of each of the bolts 15 has a larger diameter than the aperture 34 of the manipulation plate 30. Typically the head 15*h* of each bolt 15 is spaced axially away from the upper surface of the manipulation plate 30, defining an axial clearance between the head 15*h* and the plate 30. The axial freedom of movement of the bolt 15 and the magnet device to which it is attached is limited by the spacing between the head of the bolt 15*h* and the upper surface of the manipulation plate 30. Typically the small axial clearance between the head 15*h* of each bolt 15 and the upper surface of the manipulation plate 30 allows each magnet to move axially downwards parallel to the shaft of the bolt 15, until the head 15*h* of the bolt 15 abuts the upper surface of the manipulation plate 30, at which point, further axial displacement of the magnet device 10 relative to the manipulation plate 30, and relative to the other magnet devices, is not possible. Thus the connection arrangement permits relative axial and pivotal movement with a limited range, but prevents relative movement outside that range. The range can be adjusted by changing the length and the outer diameters of the shafts of the bolts 15.

The central body portion 32 of the manipulation plate 30 is typically fixed to the shaft 41 of a central handle 40. The shaft 41 extends through locking nuts above and below the planes of the manipulation plate 30 and the electrical contact plate 20, which connect each of the plates 20, 30 securely to the shaft 41.

The handle 40 typically has a spherical or partially spherical cap 42 which is rigidly connected to the shaft 41, and is thereby rigidly connected to the manipulation plate 30 and electrical contact plate 20. Thus while the handle 42 is rigidly connected to the manipulation plate 30, it is not rigidly connected directly to the magnet devices 10 which engage the surface(s), but instead, it is connected indirectly via the deformable members provided by the neck portions 23 of the electrical contact plate 20, which allow a certain amount of deformation and independent movement of the magnet devices 10, within the limits defined by the relative dimensions of the bolts 15 and the apertures 34 as described above.

In use, typically the surface S is cleaned of protective materials such as paint or coating, or from algae or other flora which might impede electrical contact between the connector 1 and the surface. This can be done by grit blasting or by other ways known in the art. The connector 1 is applied to a cleaned surface S of a metal structure such as a leg of an oil platform and the neodymium cores of the magnet devices 10 are strongly attracted to the metallic surface S and settle on it so that the lower faces 12 of each of the magnet devices 10 are held flat against the surface S pressing the conductive metal casing 11 against the surface S across the whole of the lower surface 12, and creating a reliable electrical connection with a large surface area. As the electrical contact plate 20 is electrically connected to the upper surface of the magnet devices 10, and connects each of the magnet devices to the body portion 22, and the cable terminal 25 thereon, it provides an extremely efficient conduit for electrical conductivity between the cable C and the lower faces 12 of the magnet devices 10. Accordingly, an anode connected to the cable C continuously feeds electrons to the magnet devices 10 for cathodic protection of the surfaces for as long as the anode remains viable.

Minor inconsistencies in the surface S where it deviates out of a planar arrangement are easily accommodated by the deformation of the neck portions 23 on the electrical contact plate 20, which permit one or more of the magnet devices 10 to change their relative orientation, in order to ensure that the inner face 12 of the magnet device 10 is parallel to the surface S, and is presenting the greatest possible surface area for electrical connection between the cable C and the surface S. Thus the magnet devices self-align in an optimal configuration of the array of magnet devices. Also each individual magnet device aligns itself with the surface in an orientation that provides the maximum contact area between that magnet device and the surface in order to maximise electrical conductivity for that particular magnet device, without damaging the electrical connectivity between the different magnet devices as the deformable member flexes to accommodate the movement. Accordingly if one of the magnet devices 10 is landed on an irregular part of the surface S for example, on a weld bead, it will self align with the surface to obtain the optimum connection between the surface S and the connector 1 without affecting the electrical connectivity between the magnet devices 10.

When the connector 1 is to be installed on or removed from the surface S, a connector installation and removal tool 50 is used. The removal and installation tool 50 has a U shaped frame 53 with hydraulic cylinders 51 extending through it and terminating in feet 52 adapted to press against the surface S to remove the connector 1. The installation and removal tool 50 also has a plate 55 mounted on the frame 53, and having a recess adapted to receive the shaft 41 of the handle, so that the plate 55 slides underneath the cap 42 parallel to the surface S. The plate 55 is rigidly connected to the frame 53, and once the frame 53 of the removal and connection tool 50 is in place as shown in FIG. 8, the hydraulic cylinders 51 are operated to extend the pistons therein and engage the feet 52 on the surfaces, to press the frame and the plate 55 upwards relative to the surface in order to overcome the force of the magnet devices 10 holding the connector 1 in place. Since the plate 55 is securely engaged with the underside of the cap 42, the upward force applied by the hydraulic cylinders 51 is transferred through the shaft 41 to the manipulation plate 30. The whole plate 30 is thereby pulled up relative to the surface S, so that the heads 31 of the plate 30 ride up the shafts of the bolts 15, until the heads 15*h* of the bolts 15 engage on the upper surfaces of the heads 31. When that happens, the shafts of the bolts 15 are then in tension, and all of the axial force applied by the hydraulic cylinders 51 is transferred through the shaft 41, the manipulation plate 30, and the shafts 15 direct to the magnet devices 10 through the direct connection between the threaded lower end of the shaft and the internally threaded aperture 14 in the magnet devices 10. Thus the strong pulling force applied by the hydraulic cylinders 51 to overcome the force of the magnet devices 10 is not transferred through the weak deformable member comprising the neck portions 23 of the electrical contact plate 20, so the connector 1 can be removed from the surfaces by the very high forces generated by the hydraulic cylinders 51 without damaging the connector or risking or losing the deformable characteristics of the electrical contact plate 20, so the connector 1 can be re-sited and reused in another area of the surface or on a different surface with minimal redressing of the connector 1.

The invention claimed is:

1. An electrical connector for connecting an anode to a subsea metal structure to be protected by the anode by cathodic protection, the connector comprising:

a terminal for an electric cable to be connected to the anode;

at least two magnet devices for attracting the connector onto a surface of the metal structure by magnetic forces acting between the magnet devices and the surface of the metal structure;

an electrical contact member electrically connecting the magnet devices to one another and to the terminal, in order to electrically connect the terminal to the surface of the metal structure through each of the magnet devices;

and wherein the magnet devices are connected by a deformable member that deforms to permit relative movement of the magnet devices relative to one another.

2. An electrical connector according to claim 1, wherein the deformable member comprises a plate.

3. An electrical connector according to claim 1, wherein the deformable member comprises a ductile or malleable material, able to permanently deform under load.

4. A connector according to claim 1, wherein the magnet devices create an attractive force between the connector and the surface, which draws the magnet devices towards the surface in order to make up the connection, and wherein the deformable member deforms plastically as a result of forces applied by the relative movement of the magnet devices, permitting the magnets to align themselves independently under the force of the magnetic attraction generated by each magnet device.

5. A connector according to claim 1, wherein at least one of the magnet devices comprises a rare earth magnet.

6. A connector according to claim 1, wherein at least one of the magnet devices comprises a magnet enclosed in a case formed from an electrically conductive material.

7. A connector according to claim 6, wherein the casing is formed from a corrosion resistant metal, and wherein the casing entirely surrounds the magnet restricting seawater ingress through the case.

8. A connector according to claim 1, wherein the magnet devices have flat surfaces to connect to the metal structure being protected.

9. A connector according to claim 1, wherein the connector has a manipulation plate connected to each of the magnet devices, and spaced away from the magnet devices.

10. A connector according to claim 1, wherein the electrical contact member is formed in a single piece from an electrically conductive material and is connected to the cable terminal, and the magnet devices, so as to form an electrical connection between the cable, terminal, electrical contact member and the magnet devices in contact with the metal structure to be protected.

11. A connector according to claim 1, wherein the electrical contact member comprises a copper plate.

12. A connector according to claim 1, wherein the deformable member comprises a portion of the electrical contact member.

13. A connector according to claim 1, wherein the electrical contact member has a head portion attaching to each magnet device, wherein each of the head portions has a respective neck portion, and wherein the electrical contact member has a central body portion connected to each of the head portions by a respective neck portion.

14. A connector according to claim 13, wherein the deformable member comprises the neck portion of the electrical contact member, which presents less physical resistance to deformation than the head or body portions of the electrical contact member.

15. A connector according to claim 14, wherein the deformable neck region has a structural weakness presenting substantially less physical resistance to deformation than other parts of the electrical contact member, whereby the deformable neck region bends to accommodate relative movements of the magnet devices in response to the attraction of the magnet devices to an uneven or non-planar surface on the subsea metal structure to be protected while still providing an electrical coupling between the magnet devices.

16. A connector according to claim 14, wherein the deformable member is formed from a material that is more malleable or ductile than other parts of the connector.

17. A connector according to claim 1, wherein the manipulation plate is connected to the magnet devices by at least one fixing connecting the manipulation plate directly to a respective magnet device.

18. A connector according to claim 17, wherein the manipulation plate is more resistant to deformation than the deformable member.

19. A connector according to claim 17, wherein the electrical contact device and the manipulation plate have a respective head for each magnet device.

20. A connector according to claim 1, wherein the extent of relative movement between magnet devices is limited by the manipulation plate to a range of movements within the limits of plastic deformation of the deformable member.

21. A connector according to claim 1, wherein shafts directly connect the manipulation plate and the magnet devices, wherein the shafts extend through holes formed in the manipulation plate, and terminate in sockets in the magnet devices, wherein the shaft is secured rigidly on each magnet device, but is movably restrained in the manipulation plate so that it can move within a limited range relative to the manipulation plate.

22. A connector according to claim 21, wherein the fixing is retained on the manipulation plate by a head which is larger than the hole through the plate, and wherein the shaft of the fixing passing through the hole is smaller than the hole, thereby allowing lateral movement of the shaft within the hole as the orientation of the magnet device connected to the shaft changes in response to the flexing of the deformable member as the connector settles on a non-planar surface.

23. A connector according to claim 21, wherein the head of the fixing is spaced along its axis from the upper surface of the manipulation plate, providing an axial clearance between the manipulation plate and the head, thereby allowing axial displacements of the magnet device connected to the shaft away from the plane of the other magnet devices until the head on the shaft engages with the upper surface of the manipulation plate, at which point further axial movement of the magnet device is limited by the manipulation plate.

24. A method of manipulating an electrical connector for connecting an anode and a metal structure to be protected by the anode during a cathodic protection operation, the method comprising:

providing a connector having a terminal for an electric cable to be connected to the anode, at least two magnet devices for attracting the connector onto a surface of the metal structure by magnetic forces acting between the magnet devices and the surface of the metal structure, an electrical contact member electrically connecting the magnet devices to one another and to the terminal, in order to electrically connect the terminal to the surface of the metal structure through each of the magnet devices; and connecting the magnet devices by a deformable member and allowing the deformable member to deform to permit relative movement of the magnet devices relative to one another.

25. A method according to claim 24, wherein the method includes the step of removing the connector from the surface by transferring force to the manipulation plate through the shaft, such that the manipulation plate is retracted from the surface of the metal structure without transferring all of the removal forces to the electrical contact member.

* * * * *